United States Patent [19]

Smith

[11] Patent Number: 4,493,432

[45] Date of Patent: Jan. 15, 1985

[54] TAMPER EVIDENT CLOSURE

[75] Inventor: Ernest L. Smith, Kansas City, Mo.

[73] Assignee: Sealright Co., Inc., Kansas City, Mo.

[21] Appl. No.: 558,892

[22] Filed: Dec. 7, 1983

[51] Int. Cl.[3] ..... B65D 17/34

[52] U.S. Cl. ..... 220/270; 220/276; 220/306; 220/309

[58] Field of Search ..... 220/270, 276, 306, 309; 215/256

[56] References Cited

U.S. PATENT DOCUMENTS 4,146,148 3/1979 Dwinell et al. ..... 220/270

4,190,175 2/1980 Allen ..... 220/270

*Primary Examiner*—George T. Hall

*Attorney, Agent, or Firm*—Kokjer, Kircher, Bradley, Wharton, Bowman & Johnson

[57] ABSTRACT

A closure for a food container which is constructed to visually indicate whether or not the container has been opened without authorization. The closure has a discoidal lid body and a peripheral skirt. A detachable lock ring is connected with the skirt along a weakened fold line which provides a hinge about which the lock ring is folded inwardly inside of the skirt. The rim of the container is rolled outwardly and has a free edge which interlocks with the lock ring to secure the lid on the container. The lid can be removed only after the lock ring has been removed by tearing it away from the skirt along the weakened fold line. Absence of or damage to the lock ring indicates unauthorized opening of the container or other tampering, while the presence of the lock ring confirms that the container has not been opened.

7 Claims, 5 Drawing Figures

TAMPER EVIDENT CLOSURE

BACKGROUND OF THE INVENTION

This invention relates generally to the field of food packaging and deals more particularly with a closure for a food container which provides clear signs of tampering when removed without authorization.

Cottage cheese, yogurt, ice cream and similar food products are typically packaged in relatively inexpensive disposable containers having removable lids. Normally, the container and lid are formed from either coated paperboard or injection molded thermoplastic materials such as polyethylene or polystyrene. The lid ordinarily fits tightly on top of the container so that it effectively seals the contents and yet can be easily removed and replaced. One problem with conventional food containers of this type is that the lid can be removed and the contents can be tampered with while the package is on a store shelf. After the lid has been replaced, there is no visible indication given that tampering has occurred.

Attempts have been made to provide tamper evident closures, as exemplified by U.S. Pat. Nos. 4,190,175 to Allen and 4,146,148 to Dwinell et al. These arrangements provide a tear away member such as a tear ring or diaphragm which must be torn away from the package in order to open it. Thus, a visual examination of the closure reveals whether or not it has been previously opened since the presence of the tear away member indicates a lack of tampering. After having been opened, the lid can be replaced to suitably enclose the contents of the container.

The closures shown in the aforementioned patents are so complicated and expensive that they are not practical for use on disposable containers such as those in which cottage cheese, yogurt, ice cream and similar foods are packaged. To my knowledge, a tamper evident closure which functions in a satisfactory manner and yet is sufficiently economical to be used on a food container of this type has never been available.

SUMMARY OF THE INVENTION

My invention is aimed primarily at providing such a closure such as that described above. It is the principal goal of the invention to provide a simple and economical food container and a removable lid constructed to give a clear visual indication when unauthorized opening or other tampering has occurred.

In accordance with the invention, I provide a closure lid having a discoidal body and a peripheral skirt which fits closely around the outwardly rolled rim of a food container such as a disposable thermoplastic container of the type commonly used to hold cottage cheese and similar products. During the injection molding process, a detachable lock ring is hinged to the bottom of the skirt and can be folded back inside of the skirt about the hinge axis which is formed along a weakened tear line. When the lid is applied to the food container, the lock ring is positioned immediately beneath the free edge of the container rim.

In this manner, the lock ring holds the lid securely in place on top of the container, and the lock ring must be torn along the weakened fold line before the lid can be initially removed. The skirt is provided with a cutout area immediately above the hinge line to expose part of the lock ring. Consequently, the lock ring can be torn away by pressing the thumb into the cutout to start the tear and thereafter gripping the initially torn part of the lock ring to complete the tear.

The presence of the lock ring on the closure confirms that there has not been an unauthorized opening of the container. Conversely, if the lock ring is absence or damaged, evidence of tampering is provided. After the lid has been initially opened, it can be replaced to enclose the remaining contents of the container. Preferably, the inside surface of the skirt has a stepped configuration providing a shoulder which interlocks with the free edge of the container rim to retain the lid in place after it has been replaced following the initial opening.

DETAILED DESCRIPTION OF THE INVENTION

In the accompanying drawing which forms a part of the specification and is to be read in conjunction therewith and in which like reference numerals are used to indicate like parts in the various views.

Figure 1:
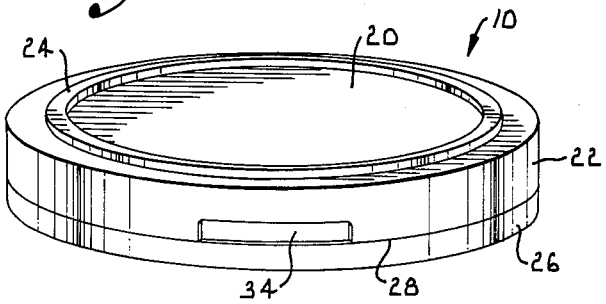
FIG. 1 is a perspective view of a tamper evident closure constructed according to a preferred embodiment of the present invention.
Figure 2:
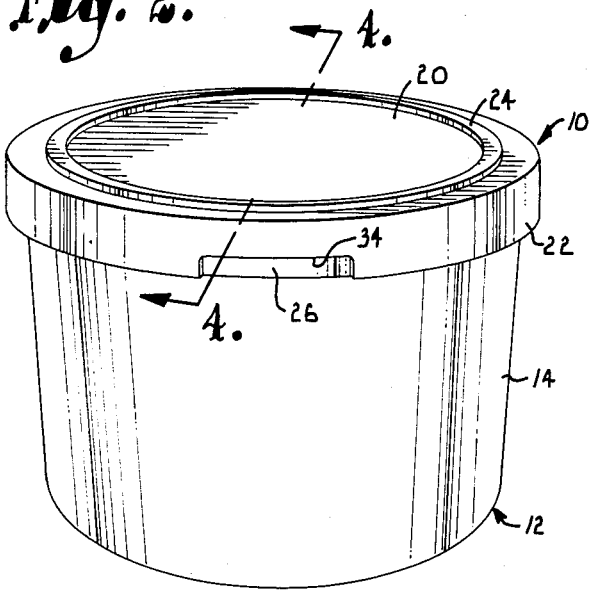
FIG. 2 is a perspective view showing the closure of FIG. 1 in place on top of a food container to enclose the contents thereof.

Referring now to the drawing in more detail, numeral 10 generally designates a tamper evident closure which serves as a lid for covering a food container 12. The container 12 can be of any suitable type such as a cylindrical or frustoconical coated paperboard container having a continuous side wall 14 closed at the bottom by the usual bottom panel (not shown). The container 12 is of the type used to contain cottage cheese, yogurt, ice cream and similar perishable food products.

Figure 4:
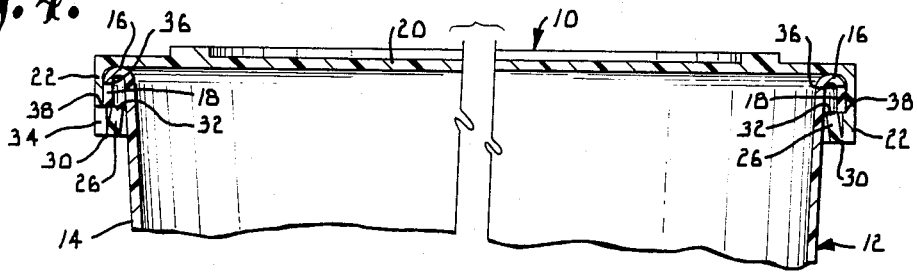
FIG. 4 is a fragmentary sectional view on an enlarged scale taken generally along line 4—4 of FIG. 2 in the direction of the arrows.
Figure 5:
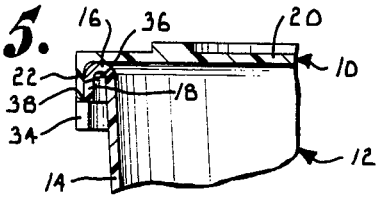
FIG. 5 is a fragmentary sectional view similar to the left hand portion of FIG. 4 but with the lock ring torn away from the closure.

As best shown in FIGS. 4 and 5, the upper edge of the container side wall 14 is rolled outwardly to provide a curved rim 16 extending around the open top of the container body. The rim 16 is circular and its outwardly rolled configuration enhance its rigidity. The outside surface of the rolled rim 16 terminates in a free lower edge which faces generally downwardly to provide a lip 18 which serves to retain the closure 10 in place on top of the container, as will be described in more detail.

The closure 10 is preferably formed in a single piece by means of injection molding or another molding process. The closure can be formed of any suitable thermoplastic material such as polyethylene, polypropylene, polystyrene or a similar material. The closure or lid 10 has a flat, discoidal body 20 having a circular periphery from which a downturned skirt 22 extends. The diameter of the lid body 20 is sufficient to locate the skirt 22 immediately outwardly of the rolled container rim 16 when the lid is applied to the container. The skirt 22 is cylindrical and has sufficient height to extend considerably below the lip 18 of the container rim. An upstanding rib 24 is formed on the top surface of the lid 20. The rib 24 is annular in shape and is spaced inwardly from the periphery of the lid.

A detachable lock ring 26 is connected in hinged fashion with the bottom of the skirt 22. The connection between the skirt 22 and the lock ring 26 is along a fold line 28 which provides a weakened tear line for tearing of the lock ring away from the skirt. The fold line 28 can be formed during the molding process by allowing for a cut extending into but not completely through the skirt 22. As best shown in FIG. 4, the fold line provides a hinge 30 about which the lock ring 26 can be folded inwardly inside of the skirt 22. The lock ring 26 has a free edge 32 which faces upwardly when the lock ring is folded inside of the skirt. The free edge 32 then interlocks with the lip 18 in order to lock the closure 10 in place on top of the container 12.

A cutout 34 is formed in the skirt 22 in order to provide access to the lock ring 26. With particular reference to FIGS. 4 and 5, the inside surface 36 of the skirt 22 has a stepped configuration to provide a small annular shoulder 38 which faces upwardly and which releasably interlocks with the downwardly facing lip 18 on the container rim.

In use, the cottage cheese, yogurt, ice cream or other food product which is to be packaged is inserted into the container 12, and the closure 10 is then applied to the container. Before the lid is applied, the lock ring 26 is folded inwardly about the fold line 28 to the locking position in which it is enclosed within the skirt 22. The closure is then applied to the container and is locked thereon in the position shown in FIG. 4. The inside surface 36 of the skirt 22 is in contact with the outside surface of the outwardly rolled container rim 16, and the peripheral region of the lid body 20 contacts the top of the rim 16. The lock ring 26 is folded about hinge 30 to the locking position in which its free edge 32 interlocks with the lip 18 to lock the closure in place on top of the container.

Figure 3:
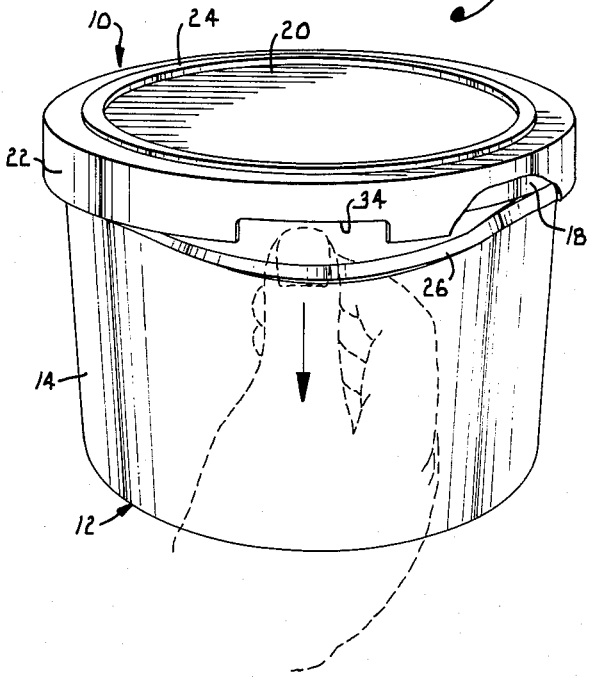
FIG. 3 is a perspective view showing the lock ring of the closure partially torn away during initial removal of the lid.

In order to initially removed the closure 10, it is necessary to tear the lock ring 26 away from the skirt 22. This is accomplished by initially inserting the thumb into the cutout area 34 of the skirt and applying thumb pressure to the exposed portion of the lock ring 26 to initiate the tear along the weakened fold line 28, as best shown in FIG. 3. Once the tear has been initiated, the torn away portion of the lock ring 26 can be grasped with the hand and torn completely away from the skirt 22. The severed lock ring can then be discarded.

After the lock ring 26 has been removed, shoulder 38 remains interlocked with lip 18 to hold the closure 10 in place on top of the container. The closure can be removed simply by pulling upwardly on the lower edge of the skirt 22 in order to disengage shoulder 38 from lip 18. After some of the contents of the container have been removed, the closure can be replaced to enclose the remaining contents. This is accomplished simply by fitting the closure on top of the container such that the shoulder 38 again interlocks with the lip 18. This holds the lid in place to retain the contents in the container and yet allows the lid to be easily removed.

The condition of the lock ring 26 provides visual evidence as to whether or not the food package has been opened without authorization or otherwise tampered with. Since the lock ring 26 must be torn away from the closure before the lid can be removed, the presence of the lock ring 26 in an undamaged condition indicates that the container has not been opened. Conversely, if the lock ring is absent or damaged, visual evidence is provided that the container has been opened or that tampering has occurred. In its locking position, the lock ring 26 is enclosed within the skirt 22, except for the portion of the lock ring that is exposed through the cutout 34.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A closure for an open topped food container having a top rim presenting a lip thereon, said closure comprising:

a lid having a size to cover the open top of the food container when applied thereto;

a skirt projecting from said lid at a location to substantially surround the container rim outwardly thereof when the lid is applied to the container;

a detachable lock ring connected to said skirt along a weakened tear line establishing a hinge connection about which the lock ring can be folded inwardly to a locking position wherein said skirt encloses said lock ring and the lock ring engages the lip of the container rim to lock said lid on the container, whereby removal of the lid requires said lock ring to be torn away from said skirt along said tear line.

2. A closure as set forth in claim 1, including a cutout in said skirt providing access to said lock ring to facilitate tearing of the lock ring away from the skirt.

3. A closure as set forth in claim 1, including:

an inside surface on said skirt disposed in contact with the top rim of the container when said lid is applied to the container; and a shoulder on said inside surface adapted to interlock with the lip of the container rim to releasably hold the lid on the container after said lock ring has been torn away from said skirt.

4. A tamper evident package for food, comprising:

a container having a sidewall terminating in an outwardly rolled top rim presenting a free edge which faces generally downwardly at a location outwardly of said sidewall;

a discoidal lid covering the top of the container and having a substantially circular periphery;

a generally cylindrical skirt on the periphery of said lid, said skirt surrounding the container rim in contact therewith; and a detachable lock ring connected to said skirt along a weakened tear line establishing a hinge connection about which said lock ring is folded inside of the skirt to be enclosed thereby, said lock ring having a locking edge engaging said free edge of the container rim to lock said lid on the container and said lock ring being detachable from the skirt about said tear line to permit removal of the lid from the container, whereby the condition of said lock ring provides evidence of whether or not tampering with the package has occurred.

5. The invention of claim 4, wherein said skirt has a cut out providing access to said lock ring to facilitate tearing of the lock ring away from said skirt.

6. The invention of claim 4, including:

an inside surface of said skirt disposed in contact with said top rim; and a generally upwardly facing shoulder on said inside surface of the skirt, said shoulder interlocking with said free edge of the container rim to releasably hold said lid on said container after said lock ring has been torn away from said skirt.

7. A tamper evident food package comprising:

a container for the food, said container having a curved sidewall which terminates in a generally circular top rim providing a downwardly facing lip located outwardly of the container sidewall;

a removable lid on the container, said lid having a discoidal shape and a substantially circular periphery;

a generally cylindrical skirt projecting from the periphery of the lid, said skirt surrounding the container rim and having an inside surface in contact therewith;

an upwardly facing shoulder on said inside surface of the skirt engaging said lip in a manner to retain the lid on the container, said shoulder being releasable from said lip to permit removal of the lid from the container;

a detachable lock ring folded within said skirt adjacent to the inside surface thereof about a fold line along which the lock ring can be torn away from the skirt, said lock ring having a free edge engaging said lip to lock the lid on the container, thereby requiring the lock ring to be torn away from the skirt along said fold line before the lid can be initially removed from the container; and a cutout in said skirt providing access to said lock ring for tearing of the lock ring away from the skirt.

* * * * *